US005379864A

United States Patent [19]

Colby

[11] Patent Number: 5,379,864

[45] Date of Patent: Jan. 10, 1995

[54] MAGNETIC SYSTEM FOR ELEVATOR CAR LATERAL SUSPENSION

[75] Inventor: Roy S. Colby, Tariffville, Conn.

[73] Assignee: Otis Elevator Company, Farmington, Conn.

[21] Appl. No.: 155,961

[22] Filed: Nov. 19, 1993

[51] Int. Cl.[6] ..... B66B 7/04

[52] U.S. Cl. ..... 187/393; 104/284; 187/409

[58] Field of Search ..... 187/95, 1 R; 104/284

[56] References Cited

U.S. PATENT DOCUMENTS 3,771,033 11/1973 Matsui et al. ..... 104/282
3,797,403 3/1974 Schwarzler et al. ..... 104/284
4,754,849 7/1988 Ando ..... 187/95

FOREIGN PATENT DOCUMENTS 0467673 1/1992 European Pat. Off. .
2273005 11/1990 Japan ..... 104/284 X

*Primary Examiner*—Robert P. Olszewski
*Assistant Examiner*—Dean A. Reichard
*Attorney, Agent, or Firm*—Francis J. Maguire, Jr.

[57] ABSTRACT

An electromagnet actuator has an E-shaped core for coupling magnetic flux between the core and a blade of a hoistway rail. A pair of coils wound on the core provide the flux in such a way as to produce both side-to-side and front-to-back forces that can be controlled by varying the current to the pair of coils in each actuator on opposite sides of the car.

12 Claims, 5 Drawing Sheets

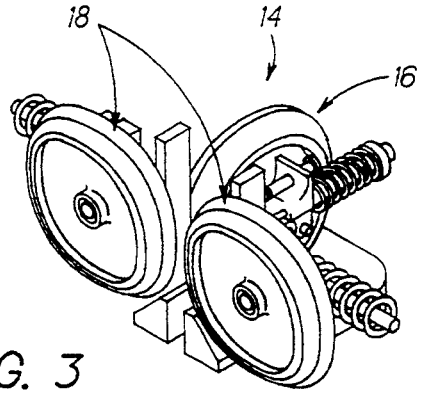
FIG. 3
PRIOR ART
FIG. 4
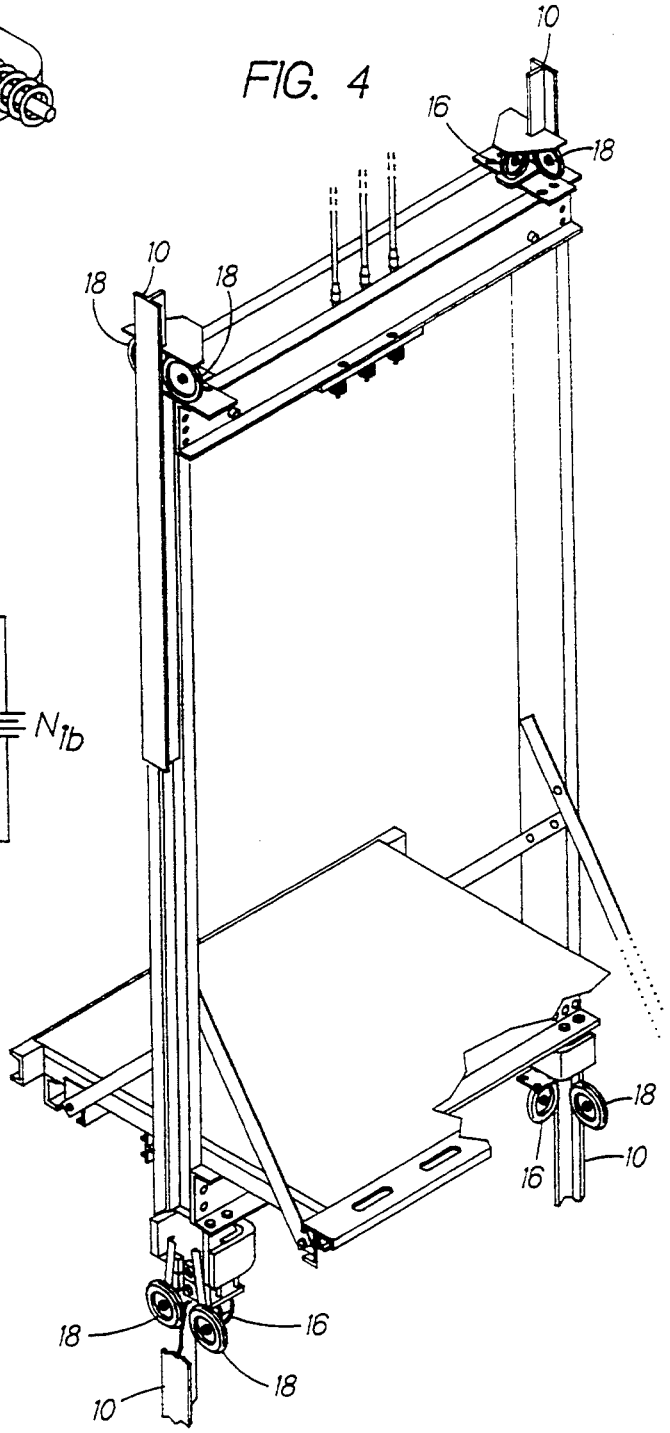
FIG. 8
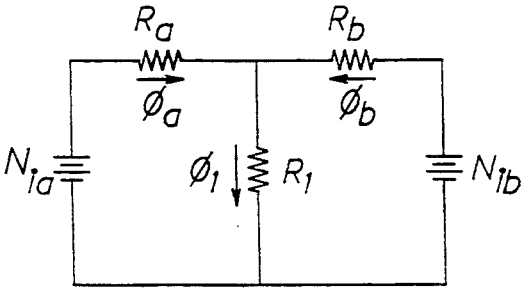

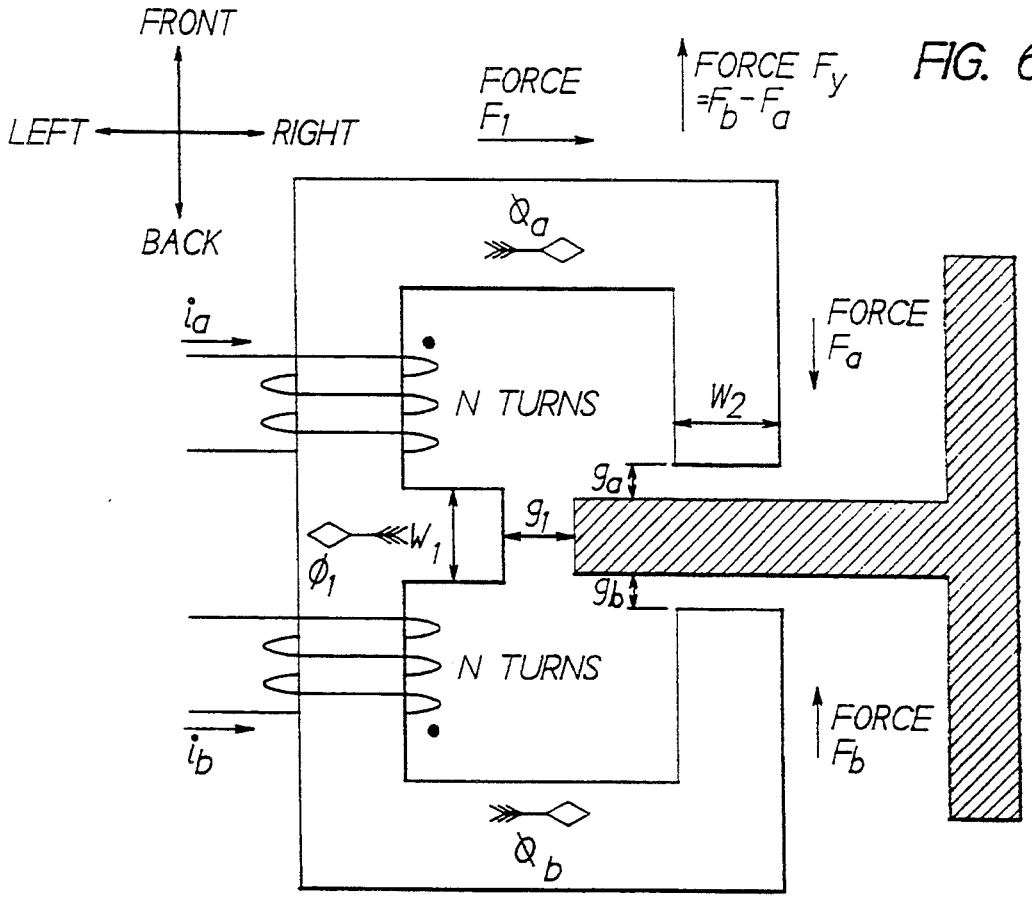
FIG. 6
FIG. 7
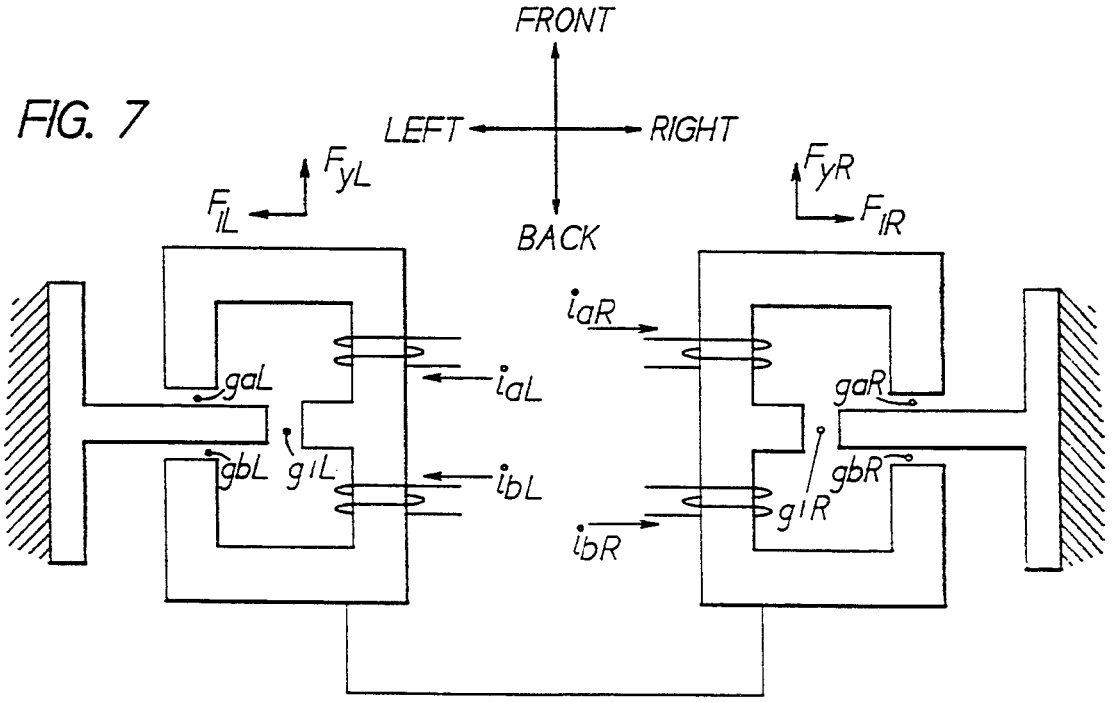

MAGNETIC SYSTEM FOR ELEVATOR CAR LATERAL SUSPENSION

TECHNICAL FIELD

The present invention relates to elevators and, more particularly, to active horizontal suspensions therefor.

BACKGROUND OF THE INVENTION

Elevator cars require suspension systems to position the car laterally in the hoistway and to cushion disturbances to the car due to load imbalance and passenger motion. The present state of the art employs a T-shaped steel guide rail 10 fitted by a bracket 12 to the side of the hoistway, as shown in FIGS. 1 and 2, and rolling wheel guides 14 as shown in FIG. 3, fixed to a car on compliant mountings, as shown in FIG. 4. The wheels roll on the guide rails to maintain the lateral position of the car and to cushion disturbance forces imposed on the car.

Forces imposed on the car are resolved into two components, named front-to-back, and side-to-side. Separate wheels are used to act in each of these directions. Side-to-side force is developed by a wheel 16 pushing against the narrow inner surface at a distal end of the rail, and front-to-back force is developed by a separate wheel 18 pushing against the broad side surface of the rail.

A limitation of the existing passive roller guide suspension systems is that irregularities in the rails are transmitted to the car frame, resulting in unwanted noise and vibration for the passengers.

An alternative approach to lateral suspension of the car is to employ actively controlled electromagnets fixed to the car to develop a force of attraction between the actuator and the guide rail. Active control of the magnets is used to offset the static forces due to load imbalance, and to provide dynamic forces to cushion disturbances. See, for example, published European Patent Application 0 467 673 A2. Active magnetic suspension is a non-contacting lateral suspension scheme that is smoother and quieter than the existing roller guide technology, and offers improved elevator ride quality. Although previous disclosures have shown electromagnet actuators, the geometry employed has not been optimized, particularly for the side-to-side actuation.

The prior art in magnetic guidance of elevator cages guided by T-shaped rails employs separate actuators for front-to-back and for side-to-side motion, at the bottom two corners or even at each of the four top and bottom corners of the elevator cage. For example, in U.S. Pat. No. 4,754,849, this will involve three separate cores and coils at each of the four corners of the elevator cage.

DISCLOSURE OF INVENTION

An object of the present invention is to provide an electromagnet actuator for an elevator horizontal suspension.

Another object of the present invention is to provide an active horizontal suspension for an elevator.

According to the present invention, an electromagnet actuator for actuating an elevator against a hoistway rail comprises an electromagnet core having an E-shape for coupling magnetic flux between the core and a blade of the rail and a pair of coils wound on the core for providing the flux.

In further accord with the present invention, the pair of coils provide the flux in two separate paths and wherein the flux from the two paths cross over gaps on opposite sides of the rail, join together in the rail, and together cross over a third gap to the core before separating into the two separate paths.

In still further accord with the present invention, the E-shape of the core forms an E with outer arms having serifs. An inner arm may be formed without a serif.

According still further to the present invention, the pair of coils of the electromagnet actuator comprise a first coil and a second coil wound on first and second halves of the core, respectively. By having the pair of coils separately wound on first and second opposite halves of the core they can provide first and second fluxes, respectively, between the first and second opposite halves of the core and respective opposite first and second sides of the blade; in this way, both the first and second fluxes may together be provided between a distal end of the blade and the core. In other words, in this way, the first and second fluxes may be provided additively between the distal end of the blade and the core. A distal end of the inside arm of the E-shaped core may have its face aligned with a face of the distal end of the rail blade and distal ends of a pair of outside arms of the E-shaped core also have their faces aligned with opposite sides of the rail blade.

In further accord with the present invention, a single actuator is employed at each of at least two corners of the elevator, each actuator comprising a single core wound with two coils. Separate, controlled excitation of the coils produces front-to-back and side-to-side force at each actuator. This arrangement reduces parts count, minimizes the number of power electronics circuits required, simplifies mechanical installation, and improves reliability over schemes employing multiple cores at each corner.

In still further accord with the present invention, an elevator car horizontal suspension for suspending the car between opposite hoistway rails comprises a pair of electromagnet actuators having E-shaped cores and positioned on opposite sides of the car adjacent a corresponding pair of rails, each actuator responsive to a pair of coil current signals for providing flux in a pair of coils wound on opposite sides of the core for exerting front-to-back and side-to-side forces between the car and the rails; sensing means, responsive to movement of the car, for providing one or more sensed signals; and a control, responsive to the one or more sensed signals, for providing the pair of coil current signals to each actuator.

These and other objects, features and advantages of the present invention will become more apparent in light of the following detailed description of a best mode embodiment thereof, as illustrated in the accompanying drawing.

BRIEF DESCRIPTION OF THE DRAWING

FIG. 3 shows a passive roller guide of the prior art.

FIG. 4 shows a prior art elevator with passive rollerguides at each corner.

FIG. 6 shows an E-core magnetic actuator, according to the present invention, with definitions of principal dimensions, geometric coordinates, magnetic fluxes and polarities.

FIG. 7 shows a pair of actuators, each similar to the actuator of FIG. 6, rigidly coupled on a car frame, according to the present invention.

FIG. 8 shows a magnetic circuit model of an E-core actuator, according to the present invention.

BEST MODE FOR CARRYING OUT THE INVENTION

As suggested above, the invention described herein employs magnetic actuators mounted in pairs on opposite sides of the car to provide the required front-to-back and side-to-side forces for lateral suspension of the car. The actuator itself employs an E-shaped core to produce a high flux density at the narrow, distal end surface of the rail in order to develop the large forces required for side-to-side actuation.

Figure 1:
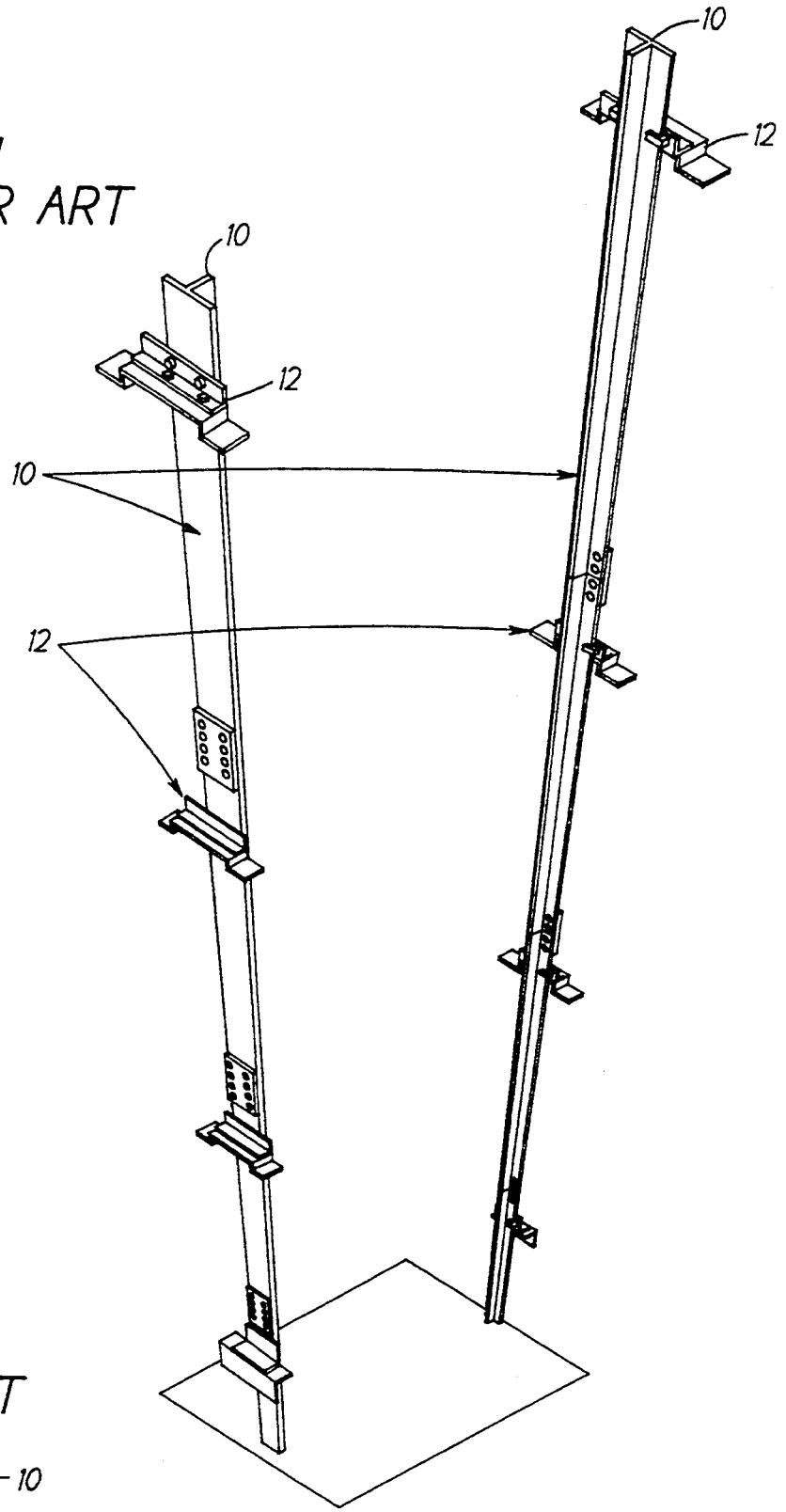
FIG. 1 PRIOR ART
FIG. 1 shows a prior art elevator hoistway with guiderails attached to the hoistway walls by rail brackets.
Figure 2:
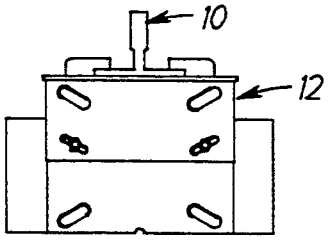
FIG. 2 PRIOR ART
FIG. 2 shows a top view of one of the rails of FIG. 1 and its associated bracket.
Figure 5:
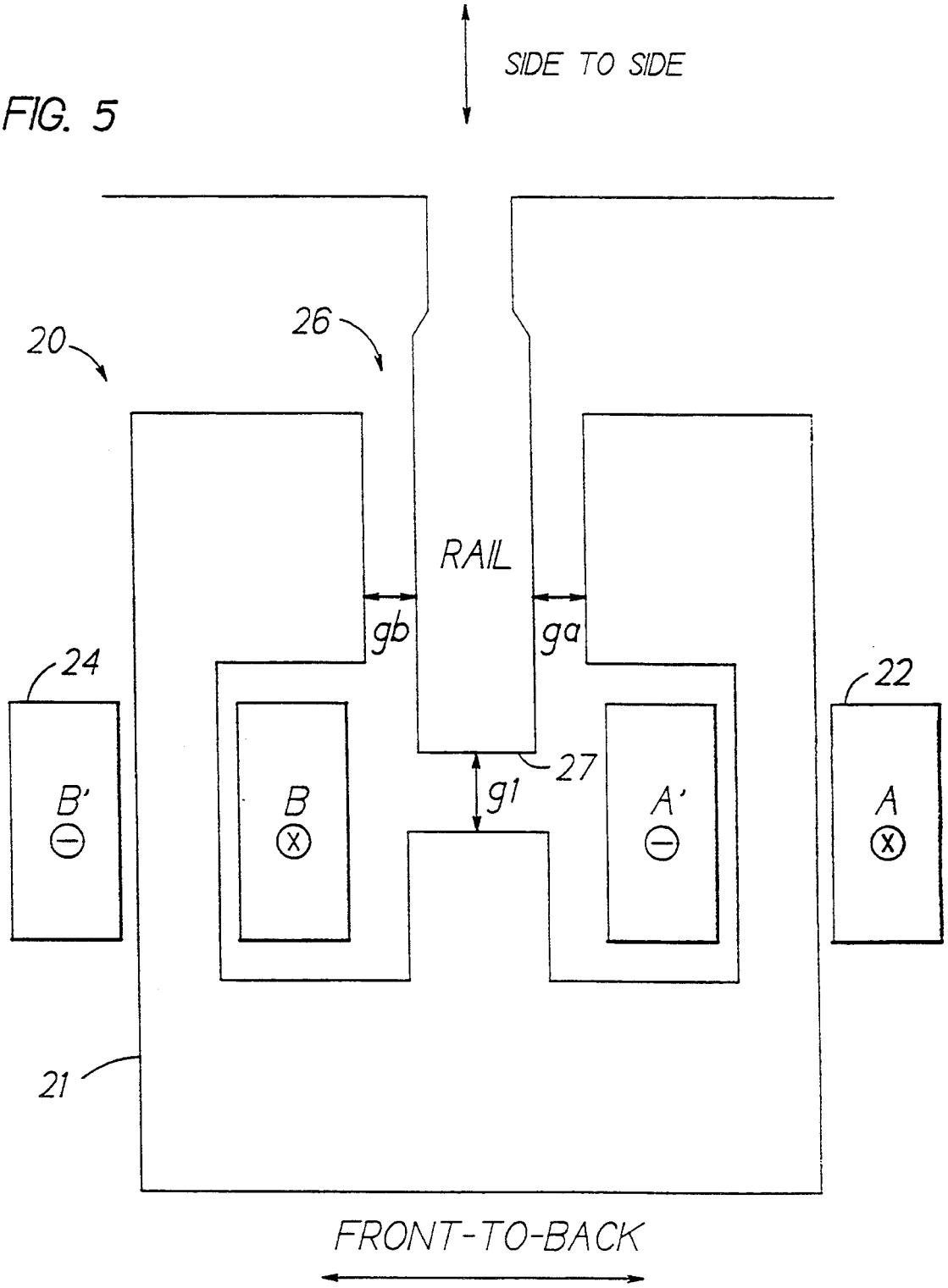
FIG. 5 shows an electromagnet actuator, according to the present invention.

A single actuator 20 is shown schematically in FIG. 5. Two coils 22, 24, labeled A and B, are wound on a core 21 and excited in such a way as to produce magnetic flux entering a rail 26 across gaps $g_a$ and $g_b$, respectively. The total flux is concentrated in a common flux return path across a gap $g_1$ at a narrow distal end 27 of the rail 26. The high flux density at the distal end 27 of the rail 26 produces a force tending to pull the rail into the core 21, reducing the gap $g_1$. The magnetic forces acting at gaps $g_a$ and $g_b$ are in opposite directions and cancel each other out for the case where the rail is centered with respect to the core, and excitation of the coils 22, 24 are equal.

Unbalanced front-to-back forces are created when the coil currents are identical and the gaps $g_a$ and $g_b$ are unequal. The unbalanced force is unstable and tends to minimize the smaller gap, i.e., when the actuator moves off-center in the front-to-back direction the unbalanced force tends to move it further off center. The unbalanced force can be eliminated by proper control of the excitation in the individual coils. When gap $g_a$ is larger than $g_b$, the current in coil A is increased and the current in coil B decreased. This increases the flux density, and hence the force in gap $g_a$ and decreases the force in gap $g_b$ to balance the net front-to-back force. Operation of the magnetic actuators in pairs mounted to opposite sides of the car, will thus produce the required side-to-side forces for lateral suspension of the car, without requiring physical contact with the rails, and without introducing unwanted forces in the front-to-back direction.

Unbalanced excitation of the coils in a single actuator is used to "steer" the flux to the front or the back side of the rail in order to produce a net front-to-back force. A control strategy is implemented to decouple the forces of a pair of actuators into front-to-back force, side-to-side force, and yaw moment.

OPERATION OF A SINGLE ACTUATOR

FIG. 6 is a more detailed schematic description of a single actuator, indicating the principal airgap and pole dimensions, geometric coordinates, magnetic fluxes, and polarities of forces, fluxes, currents, and coils. Airgaps $g_a$ and $g_b$ are defined to be at the front and the back of the rail, respectively. The effective pole width at each airgap is $w_2$. Airgap $g_1$ is defined in the side-to-side direction at the narrow surface of the rail. The effective pole width at this airgap is $w_1$. Two coils 'a' and 'b' are wound and excited so that positive current produces fluxes $\Phi_a$ and $\Phi_b$ entering the rail at the front and back airgaps. These fluxes join as $\Phi_1$ in the common return path across gap $g_1$ at the narrow surface of the rail.

FLUXES AND MMFs

FIG. 8 is a simplified magnetic circuit model of a single actuator, in which the airgap reluctances dominate. N-turn coils 'a' and 'b' produce magneto-motive forces (MMFs) $Ni_a$ and $Ni_b$ respectively. The airgap fluxes are related to the coil MMFs by $$Ni_a = \mathcal{R}_1\Phi_1 + \mathcal{R}_a\Phi_a,$$

and $$Ni_b = \mathcal{R}_1\Phi_1 + \mathcal{R}_b\Phi_b,$$

where the reluctances are given by $$\mathcal{R}_a = \frac{g_a}{\mu_o w_2 h},$$

$$\mathcal{R}_b = \frac{g_b}{\mu_o w_2 h},$$

$$\mathcal{R}_1 = \frac{g_1}{\mu_o w_1 h},$$

where h is the height of the core in the direction normal to the plane of FIG. 6 and where $\mu_0$ is the permeability constant.

The following definitions are made for airgaps and coil currents:

$$g_a = g_o + d,$$

$$g_b = g_o - d,$$

$$i_a = I_O + \Delta i,$$

$$i_b = I_O - \Delta i,$$

where $g_o$ is the average airgap in the front-to-back direction, and d is the displacement of the actuator in the forward direction, $2I_o$ is the sum of the coil currents, and $2\Delta i$ is the difference in coil currents. Solving for the fluxes, using the definitions above, yields after some simplification $$\Phi_1 = 2N\mu_o \frac{w_2}{g_o} \frac{I_o - \frac{d}{g_o}\Delta i}{1 + 2\frac{g_1 w_2}{g_o w_1} - \left(\frac{d}{g_o}\right)^2},$$

$$\Phi_2 = \frac{\Phi_1}{2} + N\mu_o \frac{w_2}{g_o} \frac{\left(1 + 2\frac{g_1 w_2}{g_o w_1}\right)\Delta i - \frac{d}{g_o} I_o}{1 + 2\frac{g_1 w_2}{g_o w_1} - \left(\frac{d}{g_o}\right)^2},$$

-continued $$\Phi_b = \frac{\Phi_1}{2} - N\mu_o \frac{w_2}{g_o} \frac{\left(1 + 2\frac{g_1 w_2}{g_o w_1}\right)\Delta i - \frac{d}{g_o} I_o}{1 + 2\frac{g_1 w_2}{g_o w_1} - \left(\frac{d}{g_o}\right)^2}.$$

These relations describe a decoupling control strategy whereby fluxes in the three airgaps may be maintained in a desired relationship by proper selection of $I_O$ and $\Delta i$.

FORCES AND FLUXES

A magnetic force of attraction exists between the rail and each of the pole faces at gaps $g_a$, $g_b$ and $g_1$. The forces are proportional to the square of the gap flux $\phi$, and are given by $$F_1 = \frac{1}{2} \frac{1}{\mu_o} \frac{\Phi_1^2}{w_1 \cdot h},$$

$$F_a = \frac{1}{2} \frac{1}{\mu_o} \frac{\Phi_a^2}{w_2 \cdot h},$$

$$F_b = \frac{1}{2} \frac{1}{\mu_o} \frac{\Phi_b^2}{w_2 \cdot h}.$$

The net force in the forward direction is $$F_y = F_b - F_a = \frac{1}{2} \frac{1}{\mu_o} \frac{\Phi_b^2 - \Phi_a^2}{w_2 \cdot h}.$$

The conservation of flux relation $\Phi_1 = \Phi_a + \Phi_b$ yields $$F_y = \frac{1}{2} \frac{1}{\mu_o} \frac{1}{w_2 \cdot h} \Phi_1(2\Phi_b - \Phi_1).$$

The above relations permit the partial decoupled control of the sideways force $F_1$ and the front-to-back force $F_y$ for a single actuator. It is required to have flux $\Phi_1$, hence force $F_1$, to produce force $F_y$, but the force $F_1$ can be held constant while $F_y$ is varied, or vice-versa.

THREE-AXIS CONTROL WITH TWO ACTUATORS

FIG. 7 is a schematic representation of two magnetic actuators as described above, mounted on opposite sides of the car frame. This arrangement permits control of three degrees of freedom: front-to-back and side-to-side translational motion, and the twisting moment about the vertical axis. Coordinate directions are defined with a side-to-side force positive in the plus X direction (to the right in FIG. 7), with a front-to-back force positive in the plus Y direction (to the front in FIG. 7) and moment about the Z axis is positive in a counterclockwise sense, looking down on FIG. 7.

The net forward force on the car is the sum of the contributions from the right and left actuators, $$F_y = F_{yR} + F_{yL}.$$

The net side-to-side force, similarly, is $$F_x = F_{1R} - F_{1L}.$$

The twisting moment about a vertical axis is $$M = R \cdot (F_{yR} - F_{yL})$$

where R is the effective moment arm.

Figure 9:
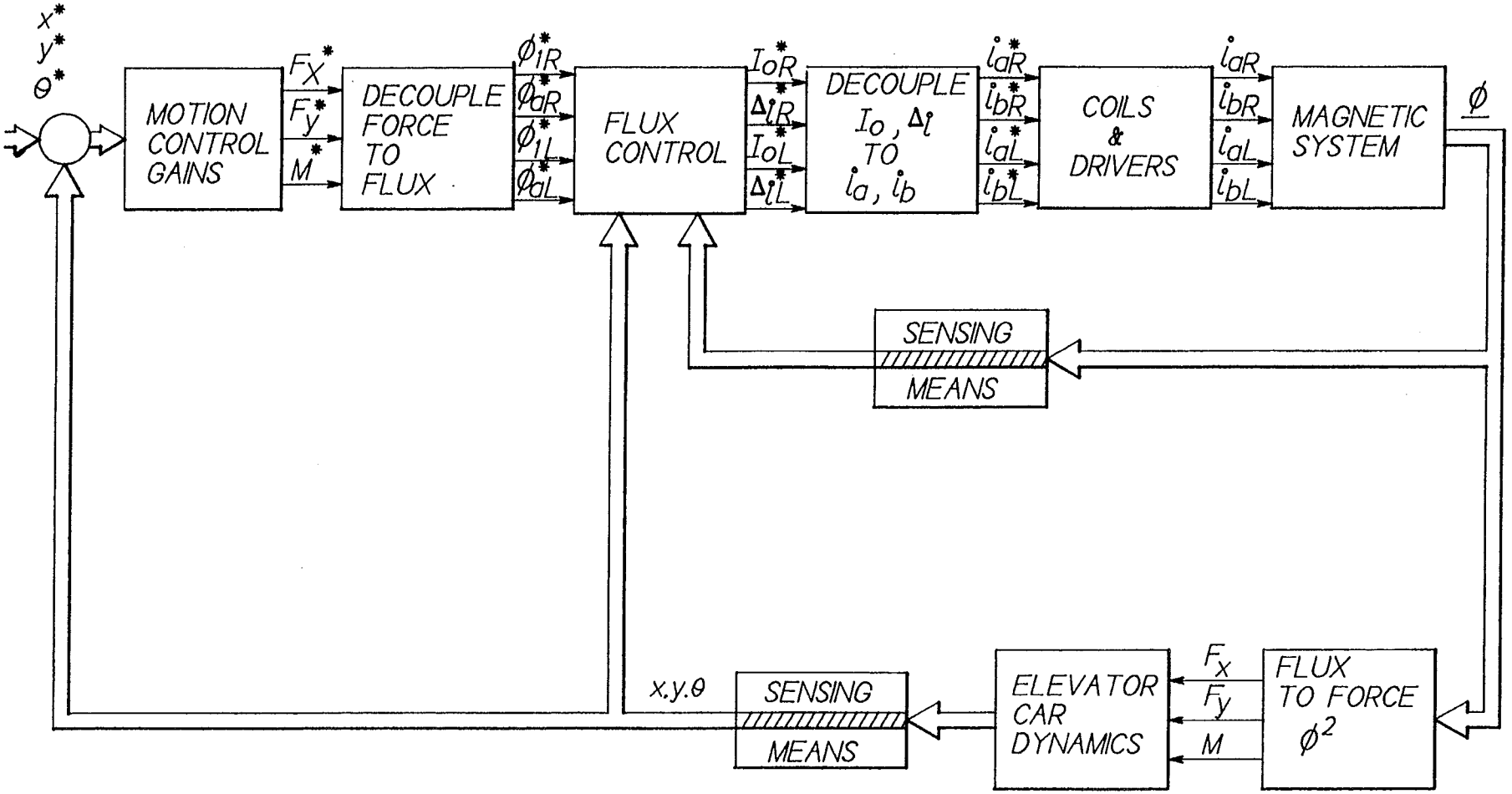
FIG. 9 shows a systems level block diagram of a control for an elevator car magnetic guidance system, according to the present invention.

FIG. 9 shows a high-level schematic of a 3-axis control for the lateral guidance of the elevator car using two magnetic actuators. The two translational motion variables x, y, and the angular variable $\theta$ are measured and compared with the reference values x*, y*, $\theta$*. The angular variable $\theta$ may be deduced from two translational measurements on each actuator as will be evident to one of skill in the art. Measured errors are used to produce force and moment commands. These commands are fed through a decoupling algorithm, embodied in the above equations, to form the flux commands. Flux command is compared with measured flux and airgap information to produce current commands $I_O$ and $\Delta i$ for each actuator. These in turn are decoupled into the individual coil current commands. Power amplifiers supply current to the coils according to the current commands. The resulting controlled fluxes produce controlled forces on the car to control the position in three degrees of freedom.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. An electromagnet actuator for actuating an elevator against a hoistway rail, comprising:

an electromagnet core having an E-shape for coupling magnetic flux between the core and a blade of the rail; and a pair of coils wound on the core for providing the flux, wherein the E-shape of the core forms an E with outer arms having serifs.

2. The electromagnet actuator of claim 1, wherein the E-shape of the core forms an E with an inner arm without a serif.

3. An electromagnet actuator for actuating an elevator against a hoistway rail, comprising:

an electromagnet core having an E-shape for coupling magnetic flux between the core and a blade of the rail; and a pair of coils wound on the core for providing the flux, wherein a distal end of an inside arm of the E-shaped core is for facing alignment with a distal end of the rail blade and wherein distal ends of a pair of outside arms of the E-shaped core are for facing alignment with opposite sides of the rail blade.

4. The electromagnet actuator of claim 3, wherein the pair of coils provide the flux in two separate paths and wherein the flux from the two paths cross over gaps on opposite sides of the rail, join together in the rail, and together cross over a third gap to the core before separating into the two separate paths.

5. The electromagnet actuator of claim 3, wherein the E-shape of the core forms an E with an inner arm without a serif.

6. The electromagnet actuator of claim 3, wherein the pair of coils comprise a first coil and a second coil wound on first and second halves of the core, respectively.

7. The electromagnet actuator of claim 3, wherein the E-shape core has an inner arm connected to a backbone having a first half connected to a first outer arm and a second half connected to a second outer arm and wherein a first coil of the pair of coils provides first flux in the first half of the backbone and the first outer arm for crossing a first gap and entering the rail blade and wherein a second coil of the pair of coils provides second flux in the second half of the backbone and the second outer arm for crossing a second gap and entering the rail blade and wherein the first and second fluxes join together in the rail blade for crossing a third gap and for together entering the inner arm and for separating in the backbone into the first and second halves.

8. The electromagnet actuator of claim 3, wherein the pair of coils are separately wound on first and second opposite halves of the core for respectively providing first and second fluxes to opposite first and second sides of the blade and for providing both the first and second fluxes between a distal end of the blade and the core.

9. The electromagnet actuator of claim 8, wherein the first and second fluxes are provided additively between the distal end of the blade and the core.

10. An elevator car horizontal suspension for suspending the car between opposite hoistway rails, comprising:

a pair of electromagnet actuators having E-shaped cores and positioned on opposite sides of the car adjacent a corresponding pair of rails, each actuator responsive to a pair of coil current signals for providing flux in a pair of coils wound on opposite sides of the core for exerting front-to-back and side-to-side forces between the car and the rails;

sensing means, responsive to movement of the car, for providing one or more sensed signals; and a control, responsive to the one or more sensed signals, for providing the pair of coil current signals to each actuator; wherein the control comprises:

summing means, responsive to two translational reference signals and one rotational reference signal and responsive to corresponding sensed signals, for providing one or more corresponding difference signals;

motion control gain means, responsive to the corresponding difference signals, providing force and moment command signals;

first decoupling means, responsive to the force and moment command signals, for providing flux command signals;

a flux control, responsive to the flux command signals and to sensed flux signals and to the translational and rotational sensed signals, for providing current command signals;

second decoupling means, responsive to the current command signals, for providing coil current command signals; and drivers, responsive to the coil current command signals, for providing the pair of coil current signals for each actuator.

11. The suspension of claim 10, wherein the sensing means comprises a pair of orthogonal position sensors for each actuator.

12. The suspension of claim 11, wherein rotation of the car about an axis parallel to the rails and midway therebetween is deduced from sensed signals provided by the orthogonal position sensors for each actuator.

* * * * *